US007340849B2

(12) United States Patent
Kim

(10) Patent No.: US 7,340,849 B2
(45) Date of Patent: Mar. 11, 2008

(54) DRUM IN DRYER AND METHOD FOR FABRICATING THE SAME

(75) Inventor: Myong Dok Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/059,679

(22) Filed: Feb. 17, 2005

(65) Prior Publication Data

US 2006/0005418 A1 Jan. 12, 2006

(30) Foreign Application Priority Data

Jul. 8, 2004 (KR) ..... 10-2004-0053033
Jul. 20, 2004 (KR) ..... 10/2004-0056195

(51) Int. Cl.
*F26B 11/02* (2006.01)

(52) U.S. Cl. ..... 34/602

(58) Field of Classification Search ..... 34/601, 34/602, 603, 242; 72/370.05, 370.08, 370.11, 72/370.19, 370.21, 370.24, 370.25, 469, 72/470, 714, 715
See application file for complete search history.

(56) References Cited

U.S. PATENT DOCUMENTS 1,645,971 A * 10/1927 Riegel ..... 72/370.08
6,465,114 B1 * 10/2002 Honda et al. ..... 428/659

* cited by examiner

*Primary Examiner*—Kenneth Rinehart
(74) *Attorney, Agent, or Firm*—Birch, Stewart, Kolasch & Birch, LLP

(57) ABSTRACT

Drum in a laundry dryer, and method for fabricating the same, wherein the drum in a dryer including a steel layer which forms a base, anti-corrosive metal film on the steel layer, and an organic film on the metal film, and the method includes the steps of providing a metal sheet having a steel layer, a metal film thereon, and an organic film thereon, rolling the metal sheet into a cylinder, and welding abut joining parts, to form a cylindrical drum, reducing diameters of opposite ends of the cylindrical drum, forming beads in a middle portion of the cylindrical drum except the reduced diameter portions, and hemming opposite edges of the cylindrical drum of the reduced diameter portions, to fold the opposite edges, respectively, thereby reducing production cost significantly, preventing easy visibility of dents in an inside circumferential surface of the drum with naked eyes different from the related art, preventing occurrence of rust, and improving bonding strength of the felt which is a sealing material.

10 Claims, 14 Drawing Sheets

DRUM IN DRYER AND METHOD FOR FABRICATING THE SAME

CROSS-REFERENCE TO RELATED APPLICATIONS

This application claims the benefit of Korean Application Nos. P2004-0053033 filed on Jul. 8, 2004, and P2004-0056195 filed on Jul. 20, 2004 which are hereby incorporated by reference as if fully set forth herein.

BACKGROUND OF THE INVENTION

1. Field of the Invention

The present invention relates to a drum in a dryer, and a method for fabricating the same, and more particularly, to a drum in a laundry dryer, and a method for fabricating the same.

2. Discussion of the Related Art

In general, the dryer is an apparatus for drying a drying object, such as clothes introduced into a drum with hot air heated by an electric heater, a gas burner, or the like, of which demand keeps increasing, recently.

FIG. 1 illustrates an exploded perspective view of a related art dryer.

Referring to FIG. 1, the related art dryer is provided with a drum 1 in a cabinet (not shown) that forms an exterior of the dryer. The drum 1 is cylindrical with opened front and rear, having a belt groove 2 along an outside circumferential surface for winding a belt (not shown) thereon to be driven by a separate driving source.

The drum 1 has a chamber 5 for holding the drying object therein, with a plurality of lifts 6 each projected a length from an inside circumferential surface of the chamber 5, for lifting/dropping the drying object during rotation of the drum 1, to turn the drying object upside down, for fast drying of the drying object.

The drum 1 forms a drying chamber 5 therein for drying laundry, and has a plurality of lifts 6 therein for lifting/dropping the drying object in the drying chamber 5 to upside down the drying object during rotation of the drum 1 for enhancing a drying efficiency.

The drum 1 is provided with a front supporter 7 and a rear supporter 9 to a front and a rear thereof opposite to each other, respectively. The front supporter 7 and the rear supporter 9 close the front and the rear of the chamber 5 and as well as support the front and the rear of the drum 1, respectively.

There is felt 10, a sealing material, between the front supporter 7 and the drum 1, and the rear supporter 9 and the drum 1 for preventing water from leaking therefrom. The felt is bonded with an adhesive 800 for metal for better attachment of the sealing material to a metal, such as stainless steel, or steel.

Or course, the front supporter 7 and the rear supporter 9 are provided with a plurality of rollers (not shown) at the front and the rear of the drum 1 for supporting the drum 1, respectively.

The front supporter 7 has an opening 8 for making the drying chamber 5 in communication with an outside of the drying chamber 5. The opening 8 is opened/closed by a door, selectively. The rear supporter 9 is provided with a hot air supply duct 12 in communication with the drying chamber 5 as a passage for supplying hot air to the chamber 5.

There is an outlet assembly 13 at one side of the front supporter 7 under the opening 8 in the front supporter 7 as a passage for escaping of air from the drying chamber 5. The outlet assembly 13 has a lint filter 14 fitted thereto. The lint filter 14 removes foreign matters (for an example, thread wastes, or dust) from the air escaping from the drying chamber 5.

There is a lint duct 15 in communication with the outlet assembly 13, extended to an inside of the lint filter 14. Connected to the lint duct 15, there is a blower 17, for drawing out air from the drying chamber 5 through the lint duct 15. A blower housing 18 has one side in communication with the lint duct 15, and the other side connected to an exhaust pipe 19. Accordingly, the air from the drying chamber 5 passed through the lint duct 15 is discharged to an outside of the drying chamber 5 through the exhaust pipe 19 by the blower 17.

In the meantime, the hot air supply duct 12 has an inlet connected to a guide funnel 16. The guide funnel 16 guides the hot air produced by burning the gas toward the inlet of the hot air supply duct.

In the meantime, in the related art, the drum applied to the dryer is fabricated by the following process.

Referring to FIG. 2, at first, a sheet of stainless steel is rolled into a cylinder, and abutting joining parts thereof are welded. Next, a diameter of a middle portion of the cylindrical drum is expanded, leaving opposite end portions as they are. In this instance, the middle portion of the drum is expanded as dies positioned on an inside thereof respectively press assigned sections of an inside circumferential surface of the drum, outwardly.

Then, beads are formed in the middle portion of the expanded drum after the expansion. Then, front and rear edges of the drum are hemmed.

However, the related art method for fabricating the drum has the following problems.

In the related art method for fabricating a drum in a dryer, the middle portion of the drum is expanded by pressing the inside circumferential surface of the middle portion of the drum with the dies. Therefore, after finishing fabrication of the drum, traces of the dies remain on the drum, resulting in a poor outer appearance. Also, as a circular shape of the drum is impaired, noise and vibration is generated during rotating the drum.

In the meantime, reasons of causing such a problem will be reviewed in detail.

As the dies mounted individually, and separately in the drum push the middle portion of the drum from an inside to an outside of the drum in a state diameters of the drum at various axial positions of the drum are hardly consistent right after the rolling and welding of the metal sheet, to expand more at a portion the diameter is small, and less at a portion the diameter is great, the traces are formed at the boundary.

Moreover, due to a difference of the expansion, an exterior of the drum is not smooth, and the diameters in the middle portion varies along axial positions of the drum, leading to cause substantial differences of roundness between the axial positions of the drum, to increase vibration and noise of the dryer having the drum applied thereto, to impair product reliability.

Along with this, the related art drum in a dryer causes the following problems due to properties of the material.

The stainless steel of the drum in the dryer makes cost of the drum very expensive. The glossy stainless steel drum is liable to form dents in an inside circumferential surface easily visible with naked eyes, formed by metal buttons attached to clothes, or coins, or shoe drying rack during mounting/dismounting.

Along with this, the drum of stainless steel is liable to make consumers misunderstood that the dryer is defective when red rust is formed on the surface of the stainless steel drum.

Moreover, the related art drum in a dryer has difficulty in protecting a surface of the drum during forming the drum because there is no portion that lubricates between the die and the sheet.

SUMMARY OF THE INVENTION

Accordingly, the present invention is directed to a drum in a laundry dryer, and a method for fabricating the same that substantially obviates one or more problems due to limitations and disadvantages of the related art.

An object of the present invention is to provide a drum in a laundry dryer, and a method for fabricating the same, which can make that dents in an inside circumference of the drum are not liable to be seen by naked eyes, and rust on the inside surface of the drum is not liable to form, can fabricate the drum at a substantially low cost, and can enhance bonding strength of the felt which prevents hot air from leaking.

Another object of the present invention is to provide a drum in a laundry dryer, and a method for fabricating the same, which leaves no traces of die separation, and improves an overall roundness of the drum, for improving reliability of the dryer when the drum is applied to the dryer.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a drum in a dryer includes a steel layer which forms a base, anti-corrosive metal film on the steel layer, and an organic film on the metal film.

Preferably, the anti-corrosive metal film and the organic film on the metal film are applied to both sides of the steel layer.

In another aspect of the present invention, a drum in a dryer includes a cylindrical body portion having a welded portion butt welded at butt parts, opening potions at opposite ends of the body each having a diameter smaller than a diameter of the body portion, bead portions formed in the body portion for reinforcing of strength the body, and hemmed portions at opening portions of the drum respectively having edges thereof folded, wherein each of the body portion, the opening portions, and the bead portions includes a steel layer which forms a base, anti-corrosive metal film on the steel layer, and an organic film on the metal film.

In another aspect of the present invention, a method for fabricating a drum in a dryer includes the steps of providing a metal sheet having a steel layer which forms a base, a metal film thereon, and an organic film thereon, rolling the metal sheet into a cylinder, and welding abut joining parts, to form a cylindrical drum, reducing diameters of opposite ends of the cylindrical drum, forming beads in a middle portion of the cylindrical drum except the reduced diameter portions, and hemming opposite edges of the cylindrical drum of the reduced diameter portions, to fold the opposite edges, respectively.

In another aspect of the present invention, a method for fabricating a drum in a dryer includes the steps of providing a steel sheet, rolling the steel sheet into a cylinder, and welding abut joining parts, to form a cylindrical drum, reducing diameters of opposite ends of the cylindrical drum, forming beads in a middle portion of the cylindrical drum except the reduced diameter portions, and hemming opposite edges of the cylindrical drum of the reduced diameter portions to fold the opposite edges respectively, coating a metal film on circumferential surfaces of the drum so as to include at least an inside circumferential surface thereof for preventing corrosion, and coating an organic film on the metal film.

In another aspect of the present invention, a drum in a dryer includes a steel layer which forms a base, an anti-corrosive metal film on the steel layer, an organic film on the metal film, felt bonded on a predetermined portion of the organic film, and plastic adhesive between the organic film and the felt for bonding the felt thereto.

In another aspect of the present invention, a drum in a dryer includes a cylindrical body portion having a welded portion butt welded at butt parts, opening potions at opposite ends of the body each having a diameter smaller than a diameter of the body portion, bead portions formed in the body portion for reinforcing of strength the body, and hemmed portions at opening portions of the drum respectively having edges thereof folded, wherein each of the body portion, the opening portions, and the bead portions includes a steel layer which forms a base, anti-corrosive metal film on the steel layer, and an organic polymer film on the metal film, and plastic adhesive is applied to edges of the opening portions, and felt is bonded to the edges of the opening with the plastic adhesive inbetween to wrap the edge.

In another aspect of the present invention, a method for fabricating a drum in a dryer includes the steps of providing a metal sheet having a steel layer which forms a base, a metal film thereon, and an organic film thereon, rolling the metal sheet into a cylinder, and welding abut joining parts, to form a cylindrical drum, reducing diameters of opposite ends of the cylindrical drum, forming beads in a middle portion of the cylindrical drum except the reduced diameter portions, and hemming opposite edges of the cylindrical drum of the reduced diameter portions, to fold the opposite edges respectively, coating plastic adhesive on the hemmed portions of the cylindrical drum, and bonding felt on the hemmed portions where the plastic adhesive is coated.

In another aspect of the present invention, a method for fabricating a drum in a dryer includes the steps of providing a steel sheet, rolling the steel sheet into a cylinder, and welding abut joining parts, to form a cylindrical drum, reducing diameters of opposite ends of the cylindrical drum, forming beads in a middle portion of the cylindrical drum except the reduced diameter portions, and hemming opposite edges of the cylindrical drum of the reduced diameter portions to fold the opposite edges respectively, coating a metal film on circumferential surfaces of the drum so as to include at least an inside circumferential surface thereof for preventing corrosion, coating an organic film on the metal film, coating plastic adhesive on inside and outside of the hemmed portions of the cylindrical drum, and bonding felt on the hemmed portions where the plastic adhesive is coated.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings;

FIGS. 6A to 6H illustrate reference state diagrams each showing a drum and a forming apparatus as the steps of a method for fabricating a drum progresses; wherein, FIG. 6A illustrates a diagram of a state before an upper die assembly moves down right before reduction of a drum diameter;

FIG. 6B illustrates a diagram of a state during reduction of drum diameter at opposite ends of the drum as an upper die assembly moves down;

FIG. 6C illustrates a diagram of a state right after reduction of drum diameter;

FIG. 6D illustrates a diagram of a state in which upper, and lower outer dies are retracted for forming bead and hemming;

FIG. 6E illustrates a diagram of a state during formation of bead;

FIG. 6F illustrates a diagram of a state after hemming;

FIG. 6G illustrates a diagram of a state in which the drum is separated as core dies contract after finish of process; and FIG. 6H illustrates a diagram of a state after an upper die assembly moves up.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 3:
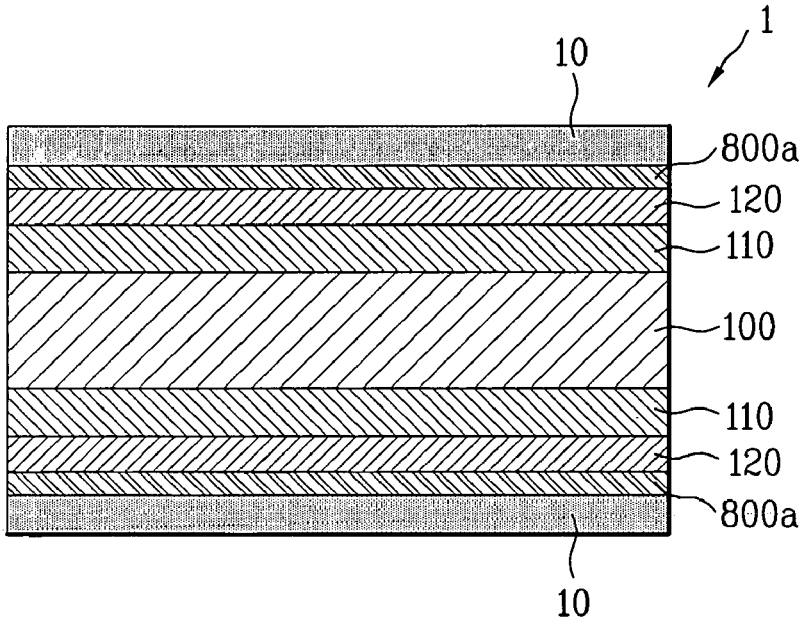
FIG. 3 illustrates a section of a drum showing material configuration of the drum in accordance with a preferred embodiment of the present invention.

FIG. 3 illustrates a section of a drum showing a material configuration of the drum in accordance with a preferred embodiment of the present invention, including a steel layer 100 which forms a base, anti-corrosion metal films 110 on the steel layer 100, organic film 120 on the metal films 110, felt 10 which are sealing members bonded on predetermined portion of the organic films 120, and plastic adhesive 800*a* placed between the organic films and the felt 10 for bonding the felt.

It is preferable that the anti-corrosive metal film 110 on the steel layer 100, and the organic film 120 on the metal film 110 are applied to opposite surfaces, i.e., upper, and lower sides of the steel layer.

It is also preferable that the felt 10 is bonded to wrap around opposite edges of the drum with the plastic adhesive 800*a*. The plastic adhesive 800*a* may be one selected from epoxy, polyester, epoxy-polyester, polychloroprene, nitrile rubber, and so on.

Meanwhile, though FIG. 3 illustrates that the anti-corrosive film 110 on the steel layer 100 and the organic film 120 on the metal film 110 are applied to the upper side, and the lower side of the steel layer 100, if the metal film and the organic film are applied only to one side of the steel layer, the drum is fabricated that the organic film 120 is on an inside of the drum, and the steel layer 100 is on an outside of the drum.

Figure 4A:
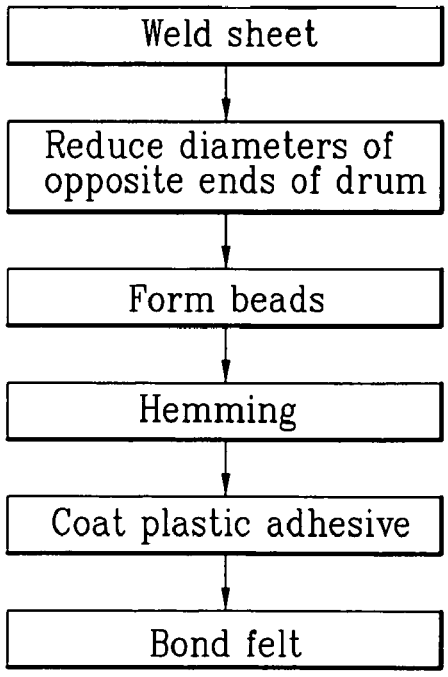
FIG. 4A illustrates a block diagram showing the steps of a method of fabricating a drum in accordance with a preferred embodiment of the present invention.
Figure 4B:
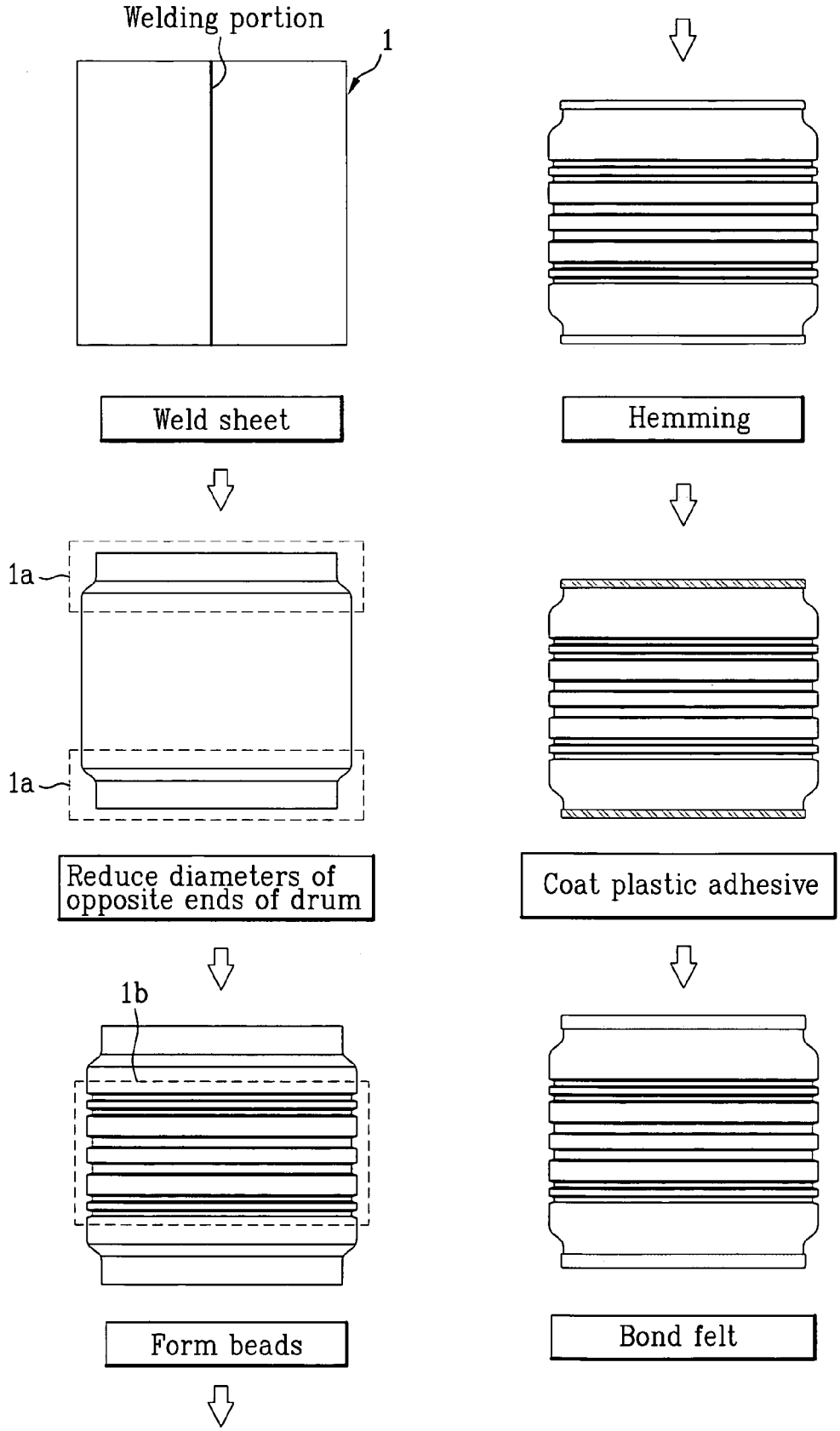
FIG. 4B illustrates a reference diagram showing states of a drum in the steps of the method for fabricating a drum of FIG. 4A.

A method for fabricating a drum of above materials in accordance with a preferred embodiment of the present invention will be outlined with reference to FIGS. 4A and 4B.

FIG. 4A illustrates a block diagram showing the steps of a method of fabricating a drum in accordance with a preferred embodiment of the present invention, and FIG. 4B illustrates a reference diagram showing states of a drum in the steps of the method for fabricating a drum of FIG. 4A.

Referring to FIGS. 4A and 4B, the method for fabricating a drum in a dryer includes the steps of forming a cylindrical drum 1, reducing diameters of opposite ends 1*a* of the cylindrical drum 1, forming beads 1*b* in a middle portion except the opposite ends 1*a* of the cylindrical drum 1, hemming opposite edges of the opposite ends of the cylindrical drum 1 by folding the opposite edges, applying plastic adhesive 800*a* to inside and outside surfaces of the opposite edges of the opposite ends of the cylindrical drum, and bonding felt 10 to the plastic adhesive 800*a* applied to the opposite edges.

In the step of forming the drum 1, a metal sheet having the steel layer 100 which forms the base, the metal film 100 on the steel layer 100, and an organic film 120 on the metal film 110 is provided, and rolled into a cylinder, and abutting joining parts are welded. That is, the joining parts are butt-welded with a plasma-TIG welder.

The steps of a method for fabricating a drum in accordance with a preferred embodiment of the present invention will be described in more detail in association with a drum forming apparatus.

Figure 5:
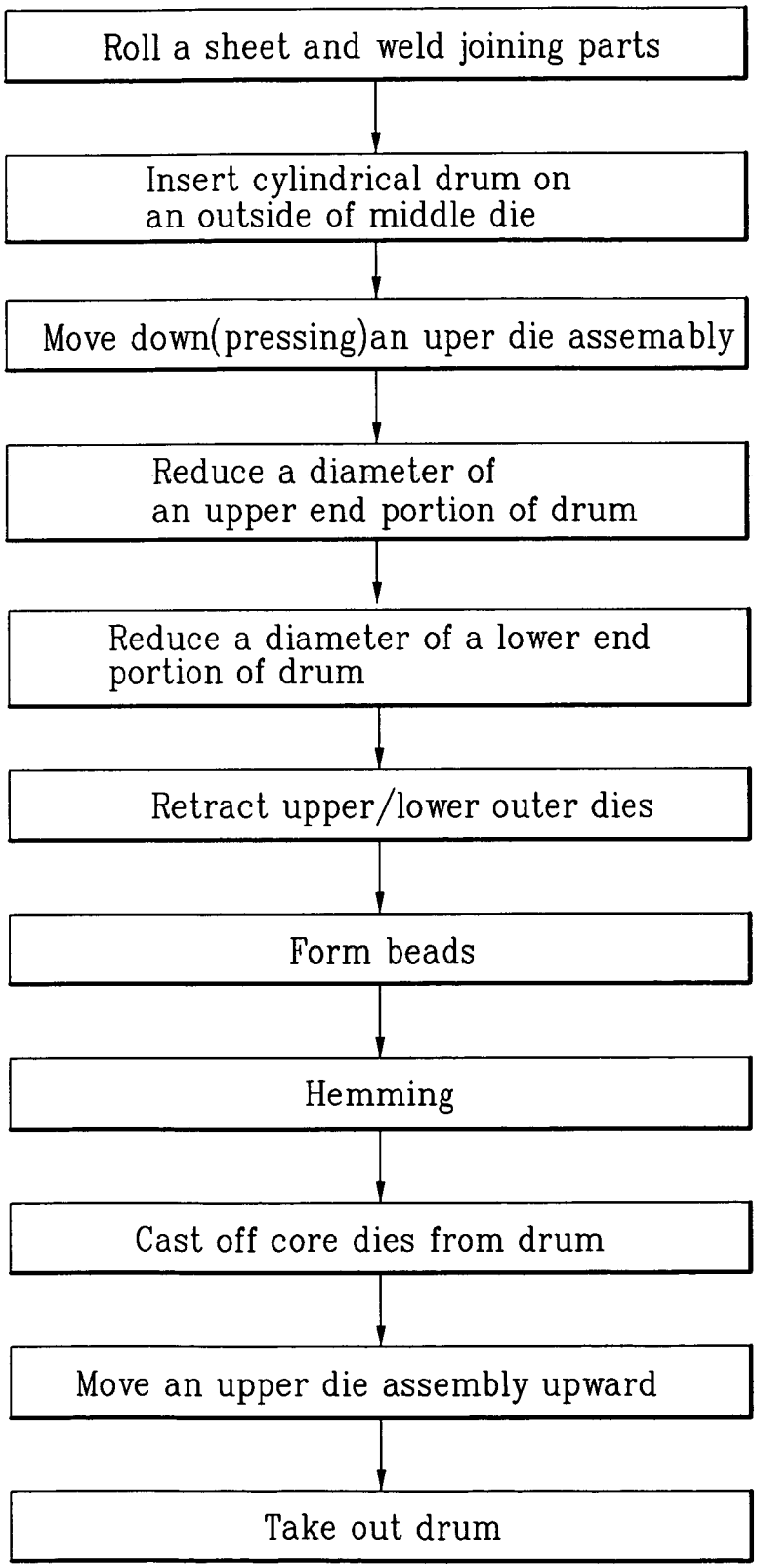
FIG. 5 illustrates a block diagram showing the steps of a method of fabricating a drum in accordance with a preferred embodiment of the present invention, in more detail.

FIG. 5 illustrates a block diagram showing the steps of a method of fabricating a drum in accordance with a preferred embodiment of the present invention, in more detail, and FIGS. 6A to 6H illustrate reference state diagrams each showing a drum and a forming apparatus as the steps of a method for fabricating a drum progresses.

The drum forming apparatus used for forming the drum 1 includes an upper die assembly 40 having a motor 30, an upper cam 41 coupled to a shaft of the motor 30, an upper core die 42 mounted to be expandable and contractable in a radial direction along the upper cam 41, and an upper outer die 43 mounted spaced outwardly from the upper core die 42 so as to be movable in up/down directions independent from the upper core die 42; a middle die assembly 50 having a middle cam 51 on a shaft in line with the shaft of the motor 30, and a middle core die 52 mounted expandable and contractable in the radial direction along the middle cam 51 having escape grooves 520 in an outside surface; a lower die assembly 60 having the same configuration with the upper die assembly 40 but positioned opposite to the upper die assembly 40; and a press (not shown) for applying a pressure to the upper die assembly 40.

That is, the lower die assembly 60 has a lower cam 61 mounted on a shaft passed through the middle core die 52, a lower core die 62 mounted to be expandable or contractable in the radial direction along the lower cam 61, and a lower outer die 63 spaced outwardly from the lower core die 62 so as to be movable in up and down directions, independently.

The drum is formed by above drum forming apparatus according to the following method.

Figure 6A:
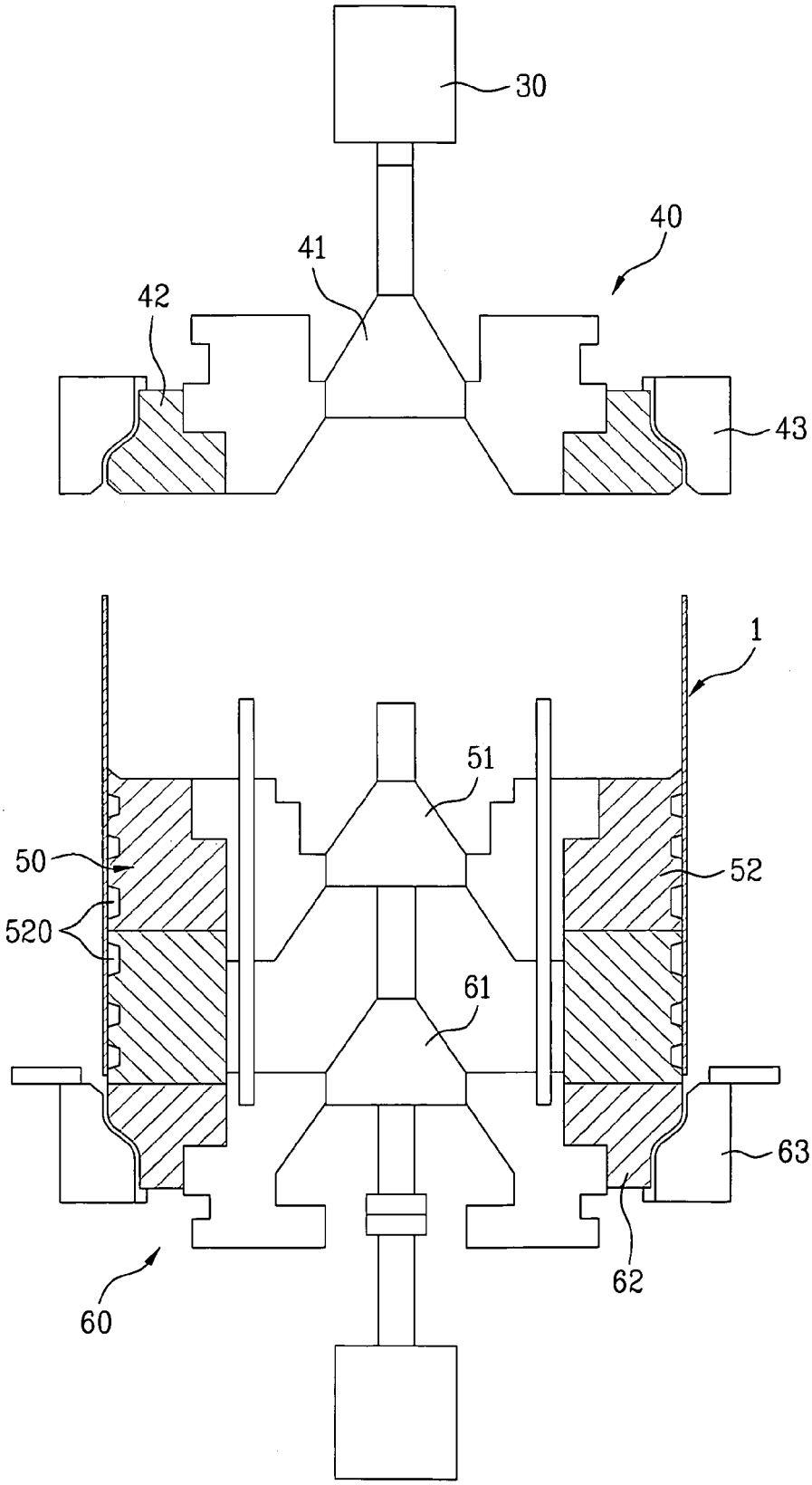

Referring to FIG. 6A, a cylindrical drum 1 is loaded on the drum forming apparatus by inserting the drum 1 on an outside of the middle core die 52 of the drum forming apparatus.

In this instance, the cylindrical drum 1 inserted on the outside of the middle core die 52 is held by the middle core die 52 and the lower core die 62. The cylindrical drum 1 may be formed by rolling a metal sheet and welding abutting joining parts, or other known methods.

Figure 6B:
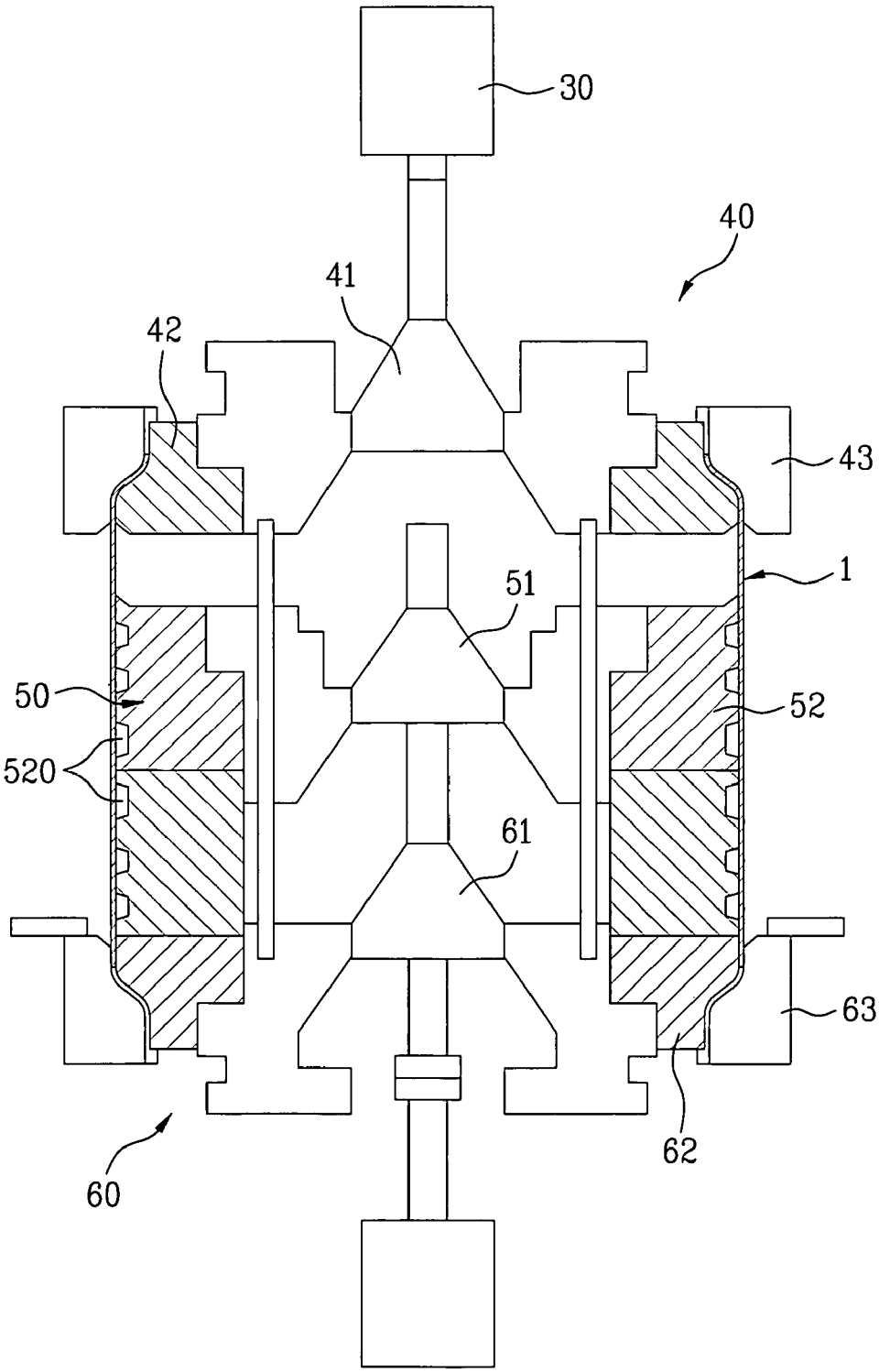

After loading the cylindrical drum 1 on the outside of the core dies in the apparatus for forming the drum, the upper die assembly 40 is pressed down by the press (not shown), such that an upper edge of the drum 1 is inserted between the upper core die 42 and the upper outer die 43 of the upper die assembly 40, to perform the step of reducing a diameter of an upper end portion of the drum 1 (see FIG. 6B).

In this instance, the upper end portion of the drum 1 is deformed by a pressure in a fashion a diameter of the drum is reduced following an inside surface profile of the upper outer die 43 having a shape in complementary to an outside surface of the upper core die 42.

Figure 6C:
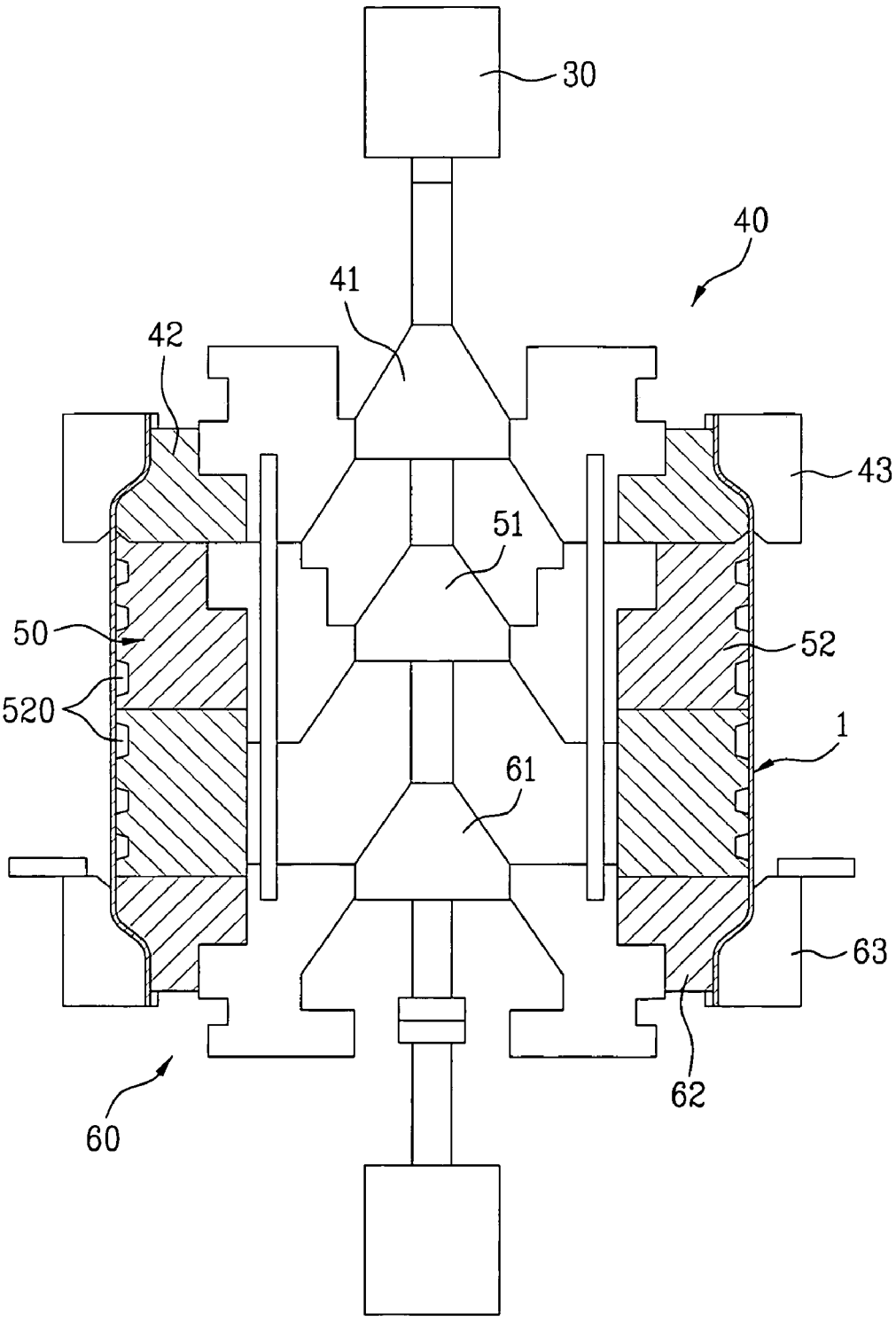

If the upper die assembly 40 keeps moving down in a state the diameter reduction of the upper end portion of the drum 1 is finished, the lower end portion of the drum 1 is inserted between the lower core die 62 and the lower outer die 63 of the lower die assembly 60, to perform the step of reducing a diameter of the lower end portion of the drum (see FIG. 6C).

Figure 6D:
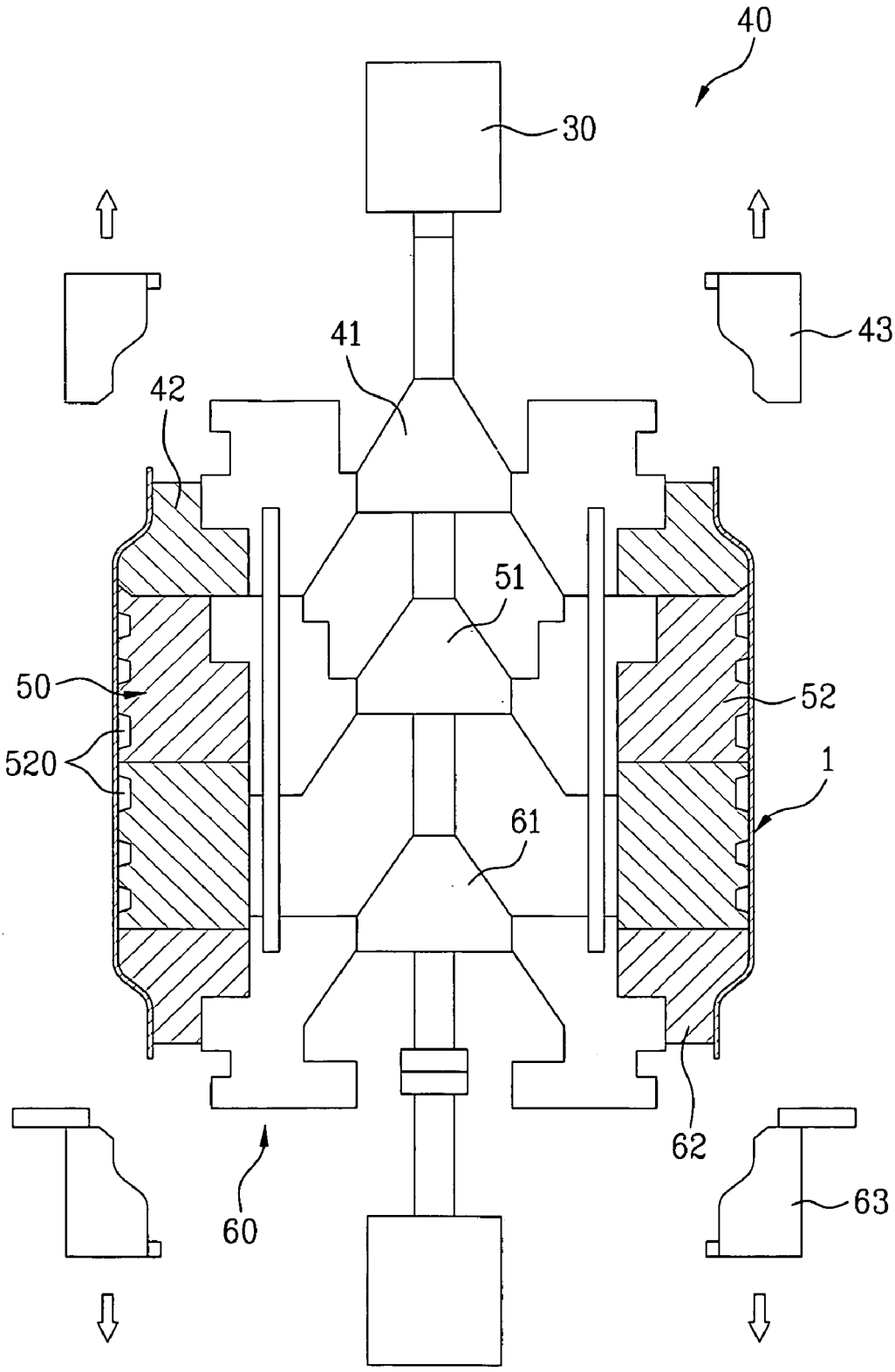

Subsequently, after completion of reduction of diameters of the lower and upper end portions of the drum 1, the retracting step of the upper outer die 43, and the lower outer die 63 is performed (see FIG. 6D).

Figure 6E:
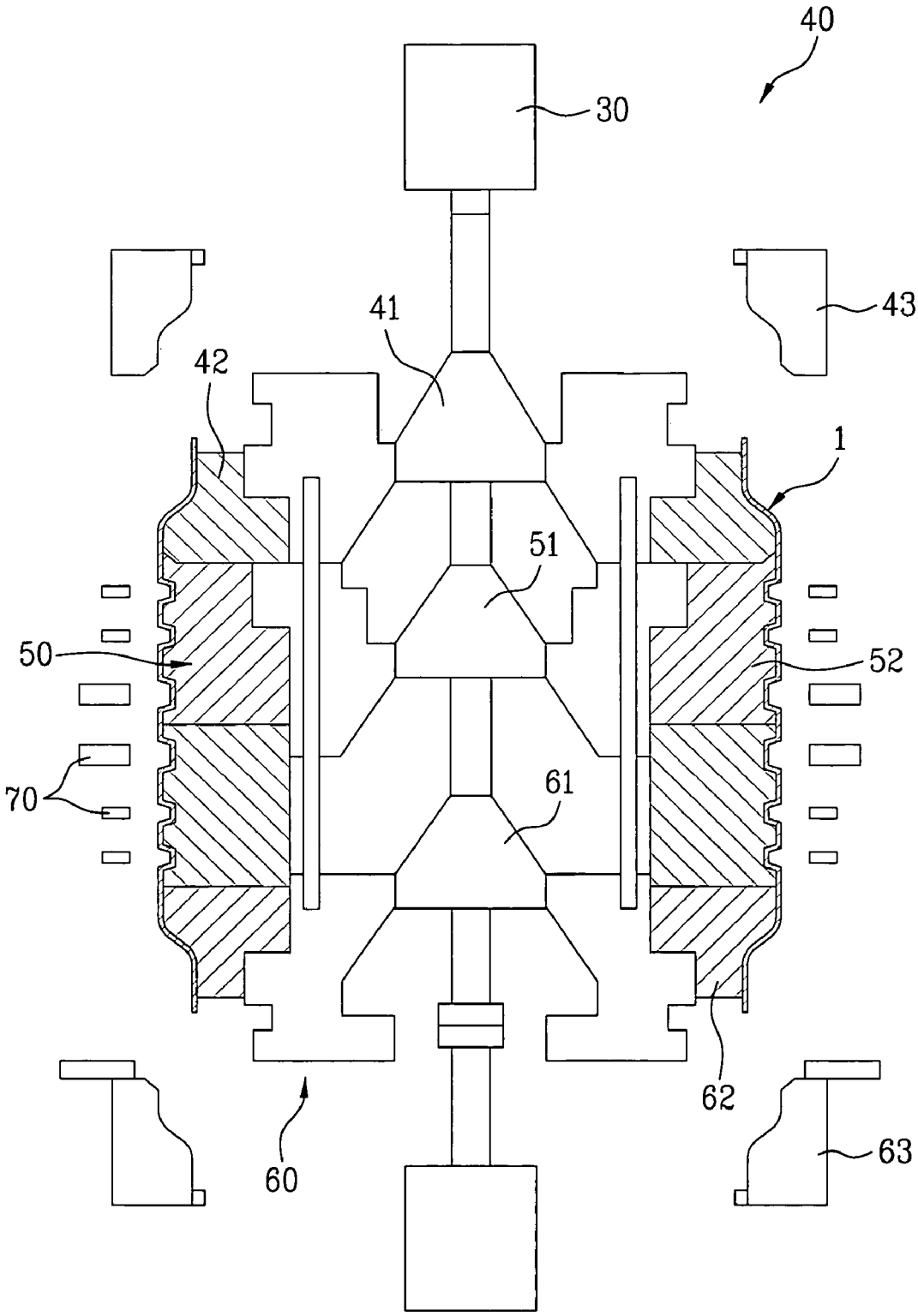

Then, beads 1*b* are formed in predetermined positions of the drum 1 excluding the opposite ends 1*a* thereof (see FIG. 6E).

In formation of the beads 1*b* in the body of the cylindrical drum 1, the motor 30 of the drum forming apparatus is put into operation to rotate the core dies, and, under this state, the rollers 70 on an outside of the drum 1 are moved to respective escape grooves 520, and press an outside circumferential surface of the drum 1 to deform portions pressed by the roller 70 according to forms of the grooves 520, to form the beads.

Figure 6F:
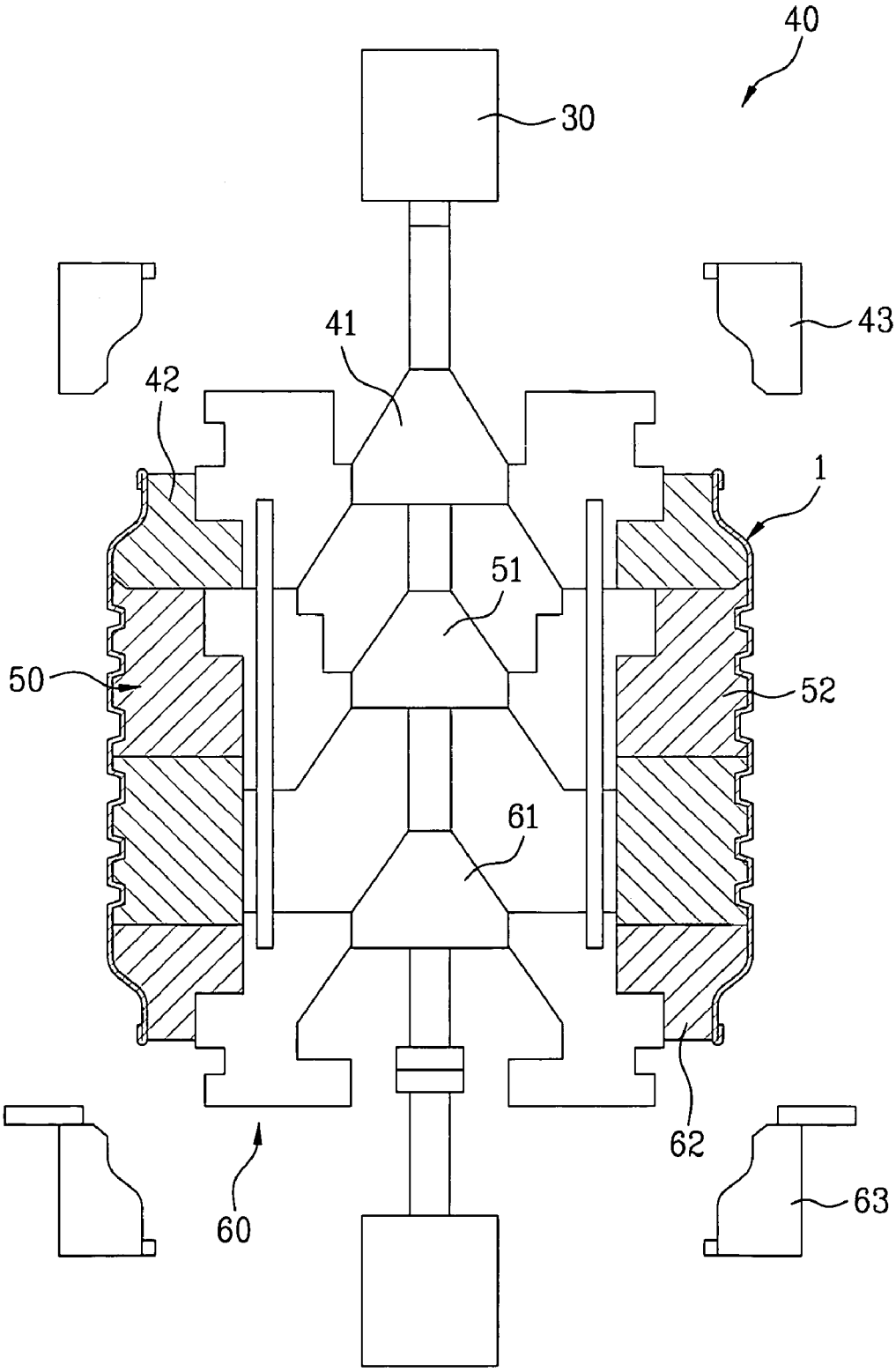

Then, after formation of the beads 1*b* is finished, opposite edges of the drum 1 are folded, i.e., hemmed (see FIG. 6F).

Figure 6G:
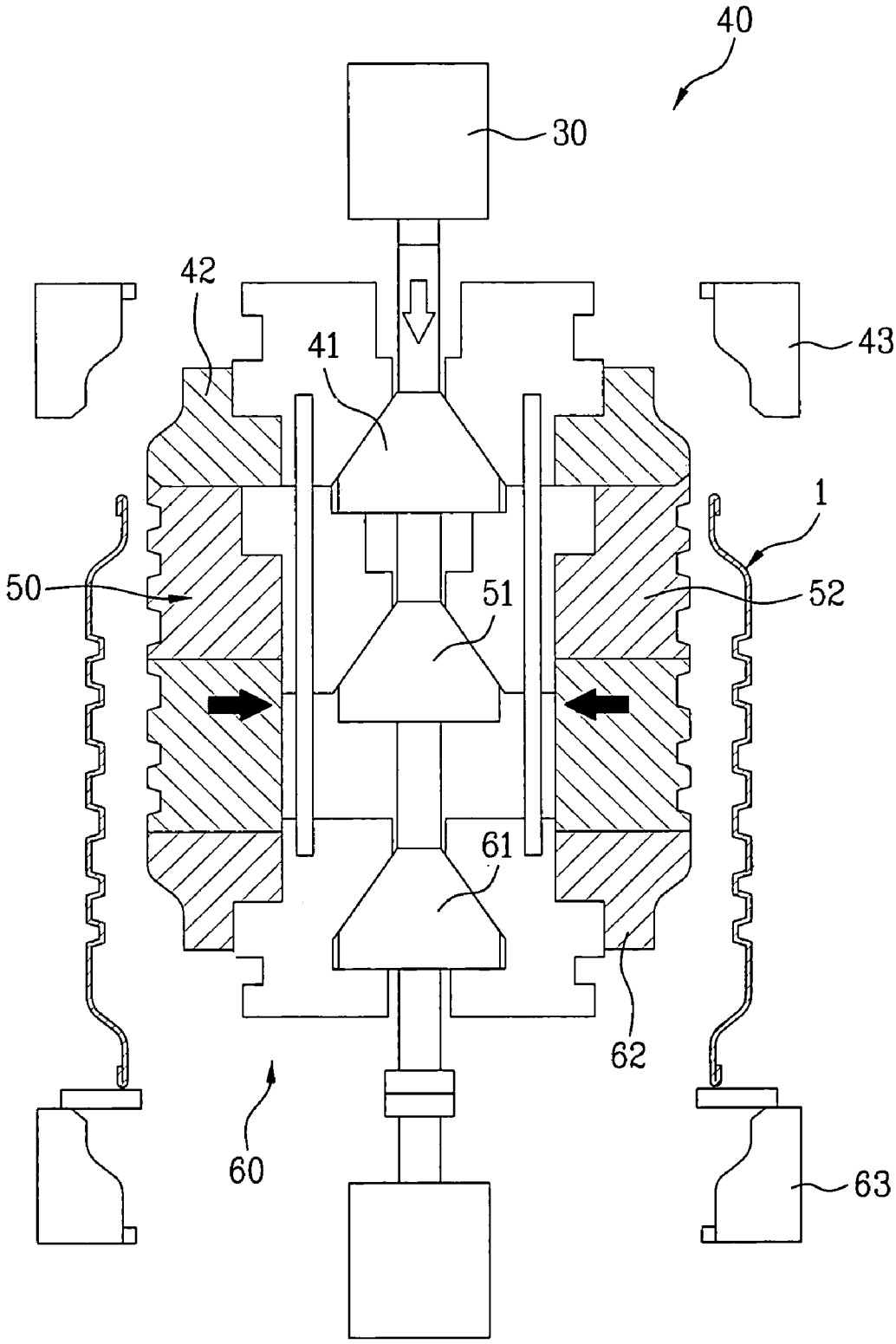

After all the steps of forming the drum is finished as the hemming of the opposite edges of the finished, the core dies 42, 52 and 62 are contracted in an arrow direction on the drawing, to cast off the drum 1 (see FIG. 6G). Accordingly, as interference between the drum 1 and the core dies are prevented, the drum 1 can be moved out of the core dies.

In this instance, before the core dies are contracted, the lower outer die 63 retracted outwardly is moved to a position at which the lower outer die 63 can support a bottom end of the drum 1.

Figure 6H:
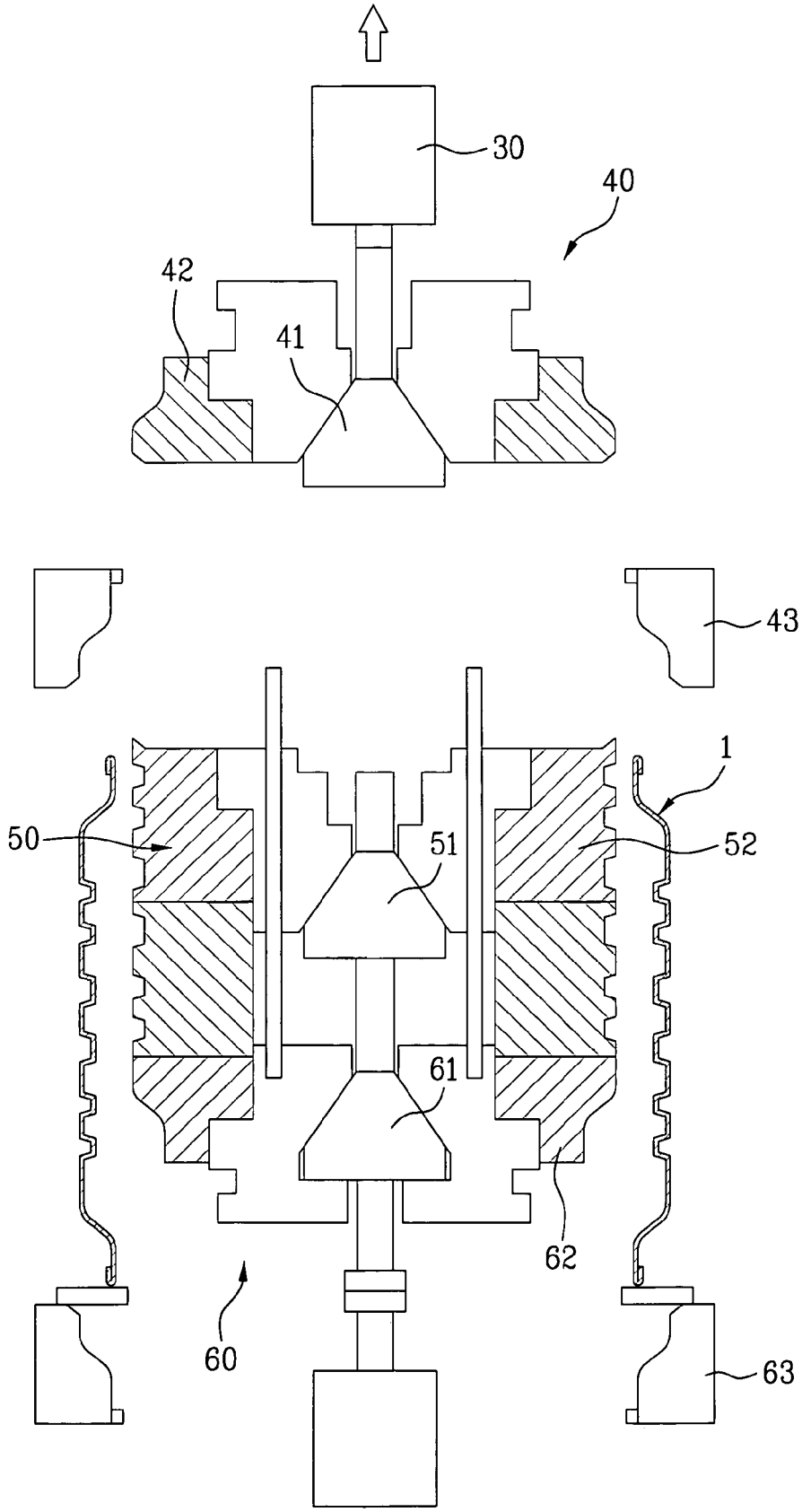

If interference even in moving upward is prevented as the upper die assembly 40 is moved up after the interference between the core dies and the drum 1 are prevented, the drum can be taken out of the apparatus (see FIG. 6H).

Figure 7:
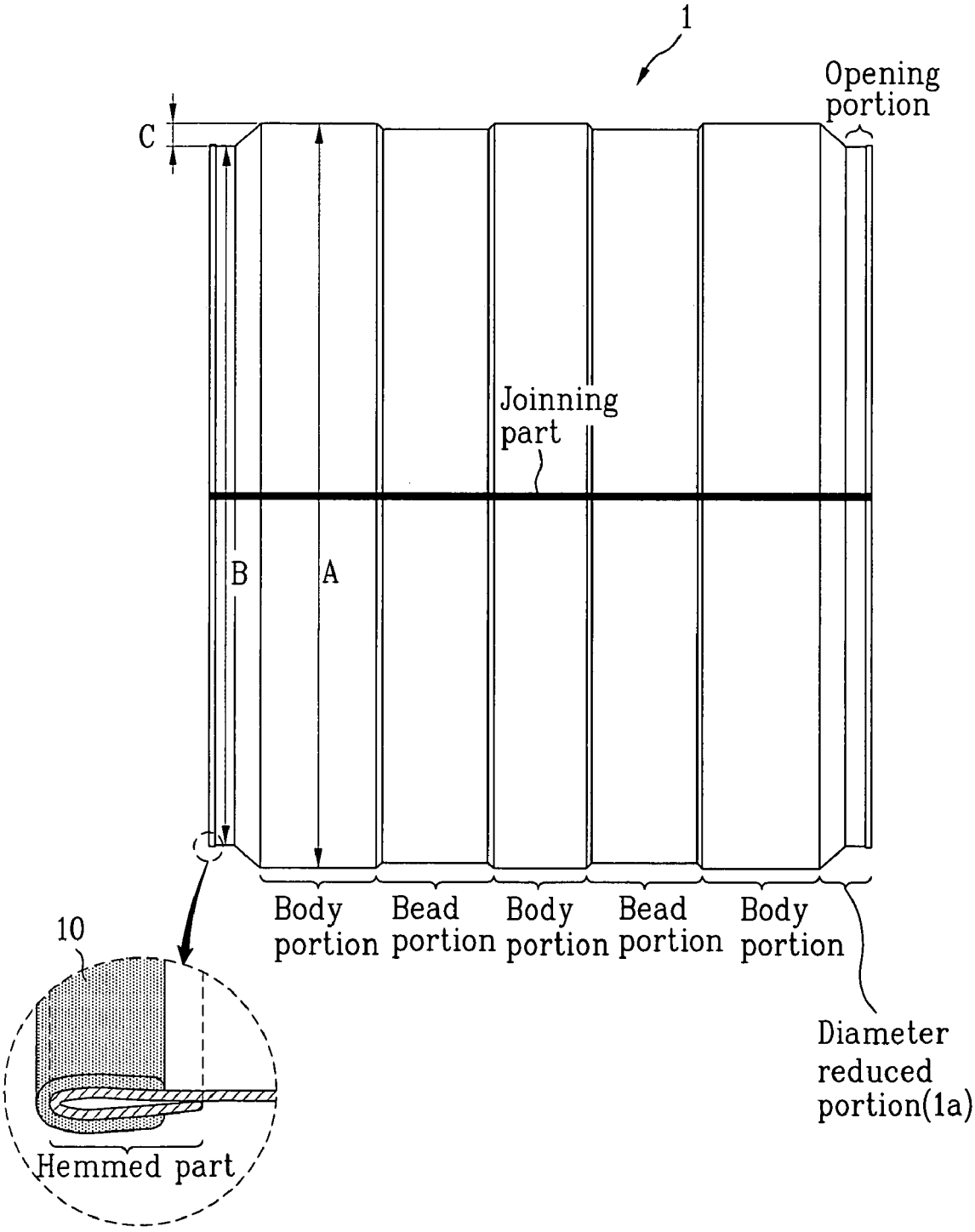
FIG. 7 illustrates a front view of a drum having a method for fabricating a drum of the present invention applied thereto.

Then, not metal adhesive, but plastic adhesive 800*a*, is applied to an inside and outside of the opposite edges (i.e., the hemmed portions) of the drum, and felt 10 is bonded to wrap around opposite edges of the drum (see FIG. 7).

Thus, in a case the felt 10 is bonded to the drum, instead of metal adhesive of the related art, the plastic adhesive 800*a* is used, because the metal adhesive of the related art impairs adhering capability of the felt to the drum due to the organic film on the surface of the drum.

In this instance, since the felt 10 has a form of a "⊂" or "⊃" section substantially (see the enlarged part in FIG. 7), the felt 10 is inserted on the edge, and bonded to the edge of the drum with the plastic adhesive 800*a*, to as a sealing member when the drum is applied to the dryer.

The reduction of diameter of opposite ends of the drum 1 instead of expansion of the middle portion of the drum 1 resolves, not only the problem of the poor outer appearance of the drum caused by traces of separate core molds remained at the middle portion of the drum 1, but also the problems of dropping roundness of the middle portion of the drum since the middle portion of the drum 1 is left intact.

Accordingly, if the drum of the present invention is applied to the dryer, the outer appearance of the drum can be maintained smooth, and minimized vibration and noise.

In the meantime, FIG. 7 illustrates a front view of a drum having a method for fabricating a drum of the present invention applied thereto.

Referring to FIG. 7, the drum 1 in a dryer includes a cylindrical body portion having a welded portion butt welded at butt parts of a metal sheet, opening potions at opposite ends of the body each having a diameter smaller than a diameter of the body portion, bead portions formed in the body portion for reinforcing of strength the body, and hemmed portions at opening portions of the drum respectively each having a felt 10 bonded thereon with plastic adhesive 800*a*.

The metal sheet has a thickness of 0.5~0.8 mm, and, more preferably, 0.55~0.7 mm.

An inside diameter (or an outside diameter) ratio of the body portion to the opening portion of the drum 1 is made to be greater than 0.9, and more preferably 0.93~0.94.

A depth "C" from the outside diameter of the body portion to the outside diameter of the opening portion is made to be below 25 mm. That is, a depth of diameter reduction "C" is made to be below 25 mm.

The anti-corrosion metal film 110 coated on the steel layer 100 of the metal sheet may be formed of aluminum or a zinc merely, or an alloy of the aluminum and zinc. Of course, composition of the aluminum and the zinc may be equal or variable. The film of aluminum or zinc may be applied by melting, and enhances resistance to corrosion and wear. The film of molten zinc coating prevents corrosion of the steel layer as the zinc itself is corroded instead of the steel layer even if the steel layer 100 is exposed, locally. The film of molten aluminum coating has high chemical resistance, high endurance, high sulfurization resistance, and high wear resistance.

The organic film 120, on the anti-corrosive metal film 110 of the metal sheet, is formed of a polymer, such as synthetic polymer of urethane, polyester, and so on, or epoxy-polyester. The organic film 120 performs lubrication at a part the dies and the metal sheet are in contact during pressing, to improve workability.

In summary, the present invention permits not only save cost by applying the anti-corrosion metal coating on general steel, but also improves formability in the pressing by means of the organic film, and the double surface treatment of the metal film and the organic film permits to improve corrosion resistance performance of the surface of the drum, to maintain an initial surface state for a long time.

In the meantime, an anti-vibration band (not shown) of rubber or metal may be attached to an outside wall of the body portion or the bead portions. Different from the drum in FIG. 4 or 7, a width, or a number of the bead portions may be varied with type of capacity of the dryer.

Though the opening portions can be formed by reducing a diameter of the drum, different from this, the opening may be formed by expanding a diameter of the body portion. For easy hemming of the opposite edges of the drum, predetermined lengths of non-welding portions may be provided at the opposite edges of the welding portions.

The requirement that the thickness of the metal sheet of the drum 1 is to be within a range of 0.5~0.8 mm has the following implications.

If the thickness of the metal sheet is below 0.5 mm, the base metal is liable to tear during the reduction or expansion of the diameter of the drum. Moreover, if the thickness of the metal sheet is below 0.5 mm, noise is loud when a metal button or the like on clothes under drying hits the drum 1.

Opposite to this, if the thickness of the metal sheet is over 0.8 mm, without question, the drum not only requires high material cost, but also, in view of formation, requires a high pressing force in reduction or expansion of the drum, and causes difficulty in assembly of the drum 1 with the cabinet due to weight. Moreover, as the drum 1 is heavy, the drum 1 imposes much load on the roller that supports the drum 1. Accordingly, in order to solve above problems, the drum 1 in the dryer of the present invention is required to have a thickness of the metal sheet to be within a range of 0.5~0.8 mm.

Next, the inside (or outside) diameter ratio of the body portion to the opening portion (i.e., a ratio of drum diameter reduction) has the following implications.

When the drum 1 is fabricated by reduction (or expansion) of the drum diameter, the thickness of the metal sheet influences to an extent of diameter reduction of the drum 1. That is, the diameter reduction of the drum 1 uses ductility of metal, if the thickness of the metal sheet is too thin, the diameter reduction of the drum is not possible.

Figure 1:
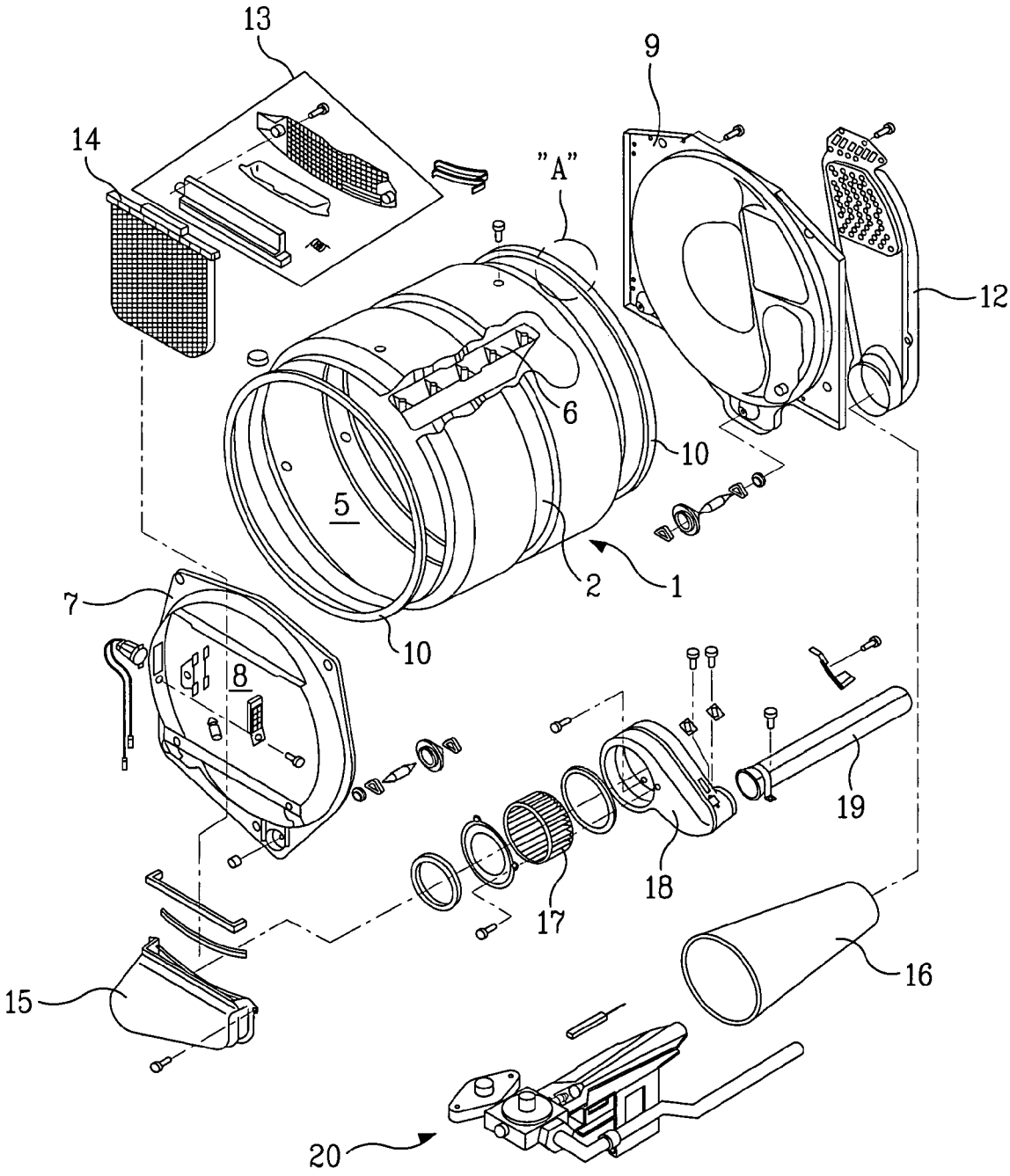
FIG. 1 illustrates an exploded perspective view of a related art dryer.
Figure 2A:
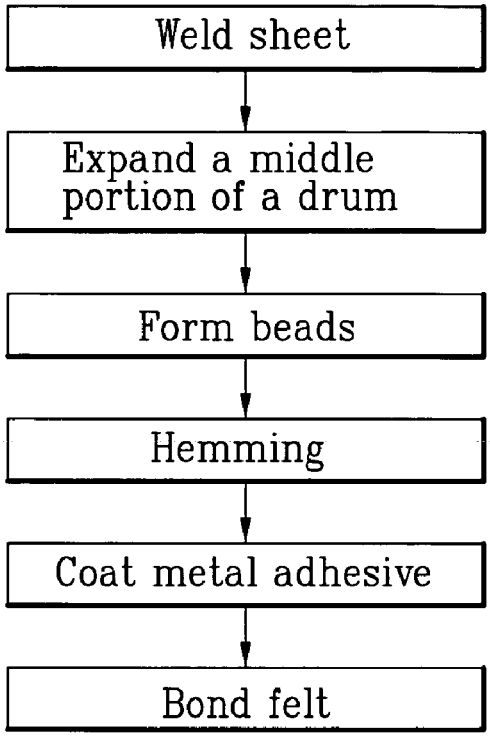
FIG. 2A illustrates a block diagram showing the steps of a related art method of fabricating a drum.
Figure 2B:
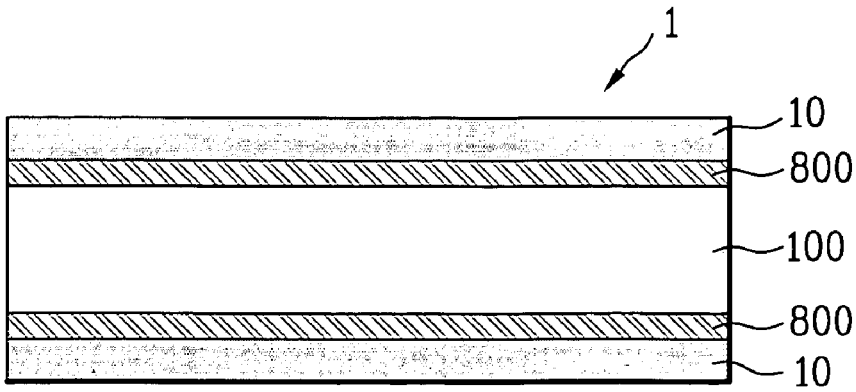
FIG. 2B illustrates a section of "A" part in FIG. 1 for describing the related art drum.

In the meantime, in order to increase a capacity of the drum 1 within a limited inside size of the cabinet, and in order to take a relation between the opening portion of the drum 1 and the front support 7(see FIG. 1) at the front of the drum into account, it is required to reduce diameters of the opening portions more than certain extent from the body portion.

To do this, the present invention has been optimized through numerous experiments, such that the present invention can provide a structure of a drum in a dryer of which diameter can be reduced to a minimum thickness as required.

As a range that can satisfies above requirement, when the inside diameter ratio of the body to the opening (B/A) is over 0.9, tearing of the metal sheet can be prevented. An optimum range of the ratio is in a range of 0.93~0.94 when security and so on are taken into account.

That is, in a preferred embodiment of the present invention, the thickness of the metal sheet is 0.5 mm, the outside diameter of the body is 663 mm, a difference between the outside diameter of the body and the outside diameter of the opening portion is 40~47 mm, with a distance from the outside diameter of the body portion to the outside diameter of the opening portion (C; a depth of reduction of drum diameter) being 20~23.5 mm.

When it is assumed that the metal sheet has a thickness of 0.5 mm, the outside diameter of the body portion is 663 mm, and the inside diameter ratio of the body to the opening portion is 0.9, a difference of outside diameters of the body portion and the opening portion is 67 mm, and a distance between the outside diameter to the outside diameter of the opening portion (C; the depth of the reduction of drum diameter) is 33.5 mm.

If the depth is greater than 33.5 mm, the metal sheet is liable to tear during formation of the drum, it is preferable that the depth is below 33.5 mm.

In the meantime, in another preferred embodiment of the present invention, the depth is in a range of 44 mm when the thickness of the metal sheet is 0.6 mm.

In order to reinforce of strength of the drum, at least one bead portion is formed in the body.

Moreover, in order to absorb, or attenuate noise and vibration caused by laundry in the drum 1, anti-vibration bands are wound on the outside diameter of the body portion or the bead portions where no belt is wound. The anti-vibration band may be formed of rubber or metal, and the anti-vibration band is attached to an outside wall of the body portion or an outside wall of the bead portions, securely.

The joining parts of the drum 1 are butt welded (edges of the metal sheet is welded in a state the edges are not overlapped, but abut) with a plasma-TIG welder. This is because if the metal sheet overlaps, deformation of the overlapped portion the same with other portion can not be secured in the diameter reduction or expansion).

For hemming of the edges of the opening portions, it is required that certain lengths of opposite edges of the joining part are not welded.

In the meantime, according to another preferred embodiment of the present invention, after the steps of 6A and 6H are passed to form a drum by using the metal sheet of steel, the anti-corrosion film is applied to an inside, and outside circumferential surfaces of the drum, and subsequent to this, an organic film is applied to the metal film, to fabricate the drum of the present invention.

As has been described, the drum in a dryer has the following advantages.

Different from the related art, the improved structure of the drum in a dryer of the present invention permits to make consumers to have reliance on the product in view of outer appearance as no dint is visible even if dint occurs in an inside circumferential surface of the drum.

The double surface treatment with the metal film and the organic film enhance corrosion resistance of the inside surface of the drum.

The present invention permits production of the drum at a cost significantly lower than the related art.

Different for the related art metal adhesive (stainless steel bond), the use of plastic adhesive for bonding felt to opposite edges of the drum permits to increase bonding strength of the felt bonded to the edges of the drum, significantly.

Since no traces of individual dies are left on the drum and the roundness of the drum is improved, reliability of the dryer having the drum applied thereto can be improved.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A drum in a dryer comprising:

a steel layer which forms a base;

an anti-corrosive metal film on the steel layer;

an organic film on the metal film;

felt bonded on a predetermined portion of the organic film; and plastic adhesive between the organic film and the felt for bonding the felt thereto.

2. The drum as claimed in claim 1, wherein the anti-corrosive metal film and the organic film on the metal film are applied to both sides of the steel layer.

3. The drum as claimed in claim 1, wherein the metal film is formed of aluminum, zinc, or an alloy of them.

4. The drum as claimed in claim 1, wherein the organic film is formed of an organic polymer.

5. The drum as claimed in claim 1, wherein the organic film includes at least one of urethane, epoxy, or polyester.

6. A drum in a dryer comprising:

a cylindrical body portion having a welded portion butt welded at butt parts;

opening portions at opposite ends of the body each having a diameter smaller than a diameter of the body portion;

bead portions formed in the body portion for reinforcing a strength the body; and hemmed portions at opening portions of the drum respectively having edges thereof folded, wherein each of the body portion, the opening portions, and the bead portions includes a steel layer which forms a base, an anti-corrosive metal film on the steel layer, and an organic polymer film on the metal film, plastic adhesive is applied to edges of the opening portions, and felt is bonded to the edges of the opening with the plastic adhesive inbetween to wrap the edge.

7. The drum as claimed in claim 6, wherein the drum has a thickness of 0.5~0.8 mm.

8. The drum as claimed in claim 6, wherein an inside diameter ratio of the body portion to the opening portion is greater than 0.9.

9. The drum as claimed in claim 6, wherein a depth from an outside diameter of the body portion to an outside diameter of the opening portion is below 25 mm.

10. The drum as claimed in claim 6, wherein the felt has a "⊂" or "⊃" form so that the felt is inserted on the hemmed portions of the drum.

* * * * *